US005253404A

United States Patent [19]

Weber et al.

[11] Patent Number: 5,253,404

[45] Date of Patent: Oct. 19, 1993

[54] APPARATUS FOR DRAWING WARP YARNS INTO A WEAVING REED

[75] Inventors: Stefan Weber; Daniel Morgenthaler, both of Sargans, Switzerland

[73] Assignee: Zellweger Uster AG, Uster, Switzerland

[21] Appl. No.: 836,886

[22] Filed: Feb. 19, 1992

[30] Foreign Application Priority Data

Feb. 22, 1991 [CH] Switzerland ..... 00545/91

[51] Int. Cl.[5] ..... D03J 1/14

[52] U.S. Cl. ..... 28/204; 28/201

[58] Field of Search ..... 28/204, 205, 206, 207, 28/201, 215

[56] References Cited

U.S. PATENT DOCUMENTS

| | | | |
|---|---|---|---|
| 2,807,861 | 10/1957 | Wieneke | 28/204 |
| 3,293,721 | 12/1966 | Baumgartner | 28/204 |
| 3,407,460 | 10/1968 | Triplett | 28/204 |
| 3,444,601 | 5/1969 | Wieneke | 28/204 |
| 3,787,938 | 1/1974 | Crandall et al. | 28/204 |
| 4,891,871 | 1/1990 | Tachibana et al. | 28/205 |
| 5,136,762 | 8/1992 | Gironi | 28/204 |

FOREIGN PATENT DOCUMENTS

| | | | |
|---|---|---|---|
| 0224841 | 11/1985 | Japan | 28/204 |

*Primary Examiner*—Clifford D. Crowder
*Assistant Examiner*—Bibhu Mohanty
*Attorney, Agent, or Firm*—Burns, Doane, Swecker & Mathis

[57] ABSTRACT

Apparatus for drawing-in warp yarns into the gaps of a weaving reed includes a reed hook (22) for sequentially opening the reed gaps for the insertion of a draw-in member carrying a warp yarn, and a transport system for the stepwise transport of the weaving reed in its longitudinal direction past the reed hook location. The transport system has a first transport member (BW) extending over the length of the weaving reed and coupled to this in the operating state is a gripper-like second transport member (48, 49) for intermittent engagement with the first transport member (BW). As a result of this arrangement, the two functions of reed transport and reed opening are decoupled and can each be optimized independently. This allows the draw-in frequency to be increased. Moreover, the reed hook and reed teeth are given maximum protection.

17 Claims, 5 Drawing Sheets

APPARATUS FOR DRAWING WARP YARNS INTO A WEAVING REED

FIELD OF INVENTION

The present invention relates to apparatus for drawing warp yarns into the gaps between the teeth or dents of a weaving reed. It is concerned particularly with a drawing-in machine provided with a reed hook for opening the particular reed gap for the draw-in member carrying the warp yarn, and with transport means for the stepwise transport of the weaving reed in its longitudinal direction, the length of the individual transport steps corresponding at least approximately to the division of the reed teeth.

BACKGROUND

Apparatus of this type is also referred to as reeding apparatus. Such apparatus is used especially on automatic warp-yarn drawing-in machines. In the USTER DELTA (USTER is registered trademark of Zellweger Uster AG) warp-yarn drawing-in machine known for a long time, the reed hook serves at the same time as a transport means for the weaving reed in that it plunges into the particular reed gap and opens this and transports the reed the intended step. After drawing-in has taken place, the reed is fixed by holding means and the reed hook is drawn out of the reed gap and returns to its initial position.

This double function of the reed hook can have adverse effects, in that, during transport of the weaving reed, on the one hand the reed hook is subjected to excessive bending stress and on the other hand the reed teeth also experience high stress. Moreover, the said double function of the reed hook also places limits on the draw-in frequency, that is to say the number of warp yarns which can be drawn in per minute.

SUMMARY OF THE INVENTION

In accordance with one aspect of the present invention, drawing-in machine features are provided through which enhancements in the reeding function (that is, the drawing of warp yarns into the reed gaps) may be enhanced. In particular, features are provided to allow an increase in the draw-in rate and/or longer life for and/or less damage to the reed hook and/or the teeth (dents) of the reed.

The preferred machine structure is such that the two functions of reed transport stepwise past the drawing-in station and opening of the gap between adjacent reed dents at the drawing-in station are decoupled. A carriage removably receives the reed to be threaded with warp yarns and is mounted for movement past the drawing-in station in the direction of the length of the reed. This carriage movement is caused to take place in stepwise fashion by means of a driver which is moved to and fro and which is intermittently coupled to and decoupled from the carriage. The arrangement is such that the carriage is advanced by the driver a distance approximately the same as the pitch of the reed dents, then remains idle while the reed hook is inserted into the gap at the drawing-in station, and then is decoupled from the driver to allow the driver to return to its start position for the next cycle. The insertion and withdrawal of the reed hook is powered by means which is mechanically separate from the reed transport components but which is caused to operate in timed relation the movements of the carriage and driver.

In a preferred embodiment, the carriage for the reed includes grippable means, preferably in the form of a rail, extending over substantially the reed length occupied by the reed dents, and the driver is coupled releasably to this means by gripper means carried by the driver and constructed to provide for intermittent engagement with the rail.

The decoupling according to the invention of the two functions, namely reed transport and reed opening, allows these functions to be optimized and consequently the draw-in frequency to be increased. Furthermore, both the reed hook and the reed teeth are given maximum protection, because no bending forces act on them during the reed transport.

BRIEF DESCRIPTION OF THE DRAWINGS

The invention is explained in more detail below with reference to an exemplary embodiment shown in the drawings, in which.

DETAILED DESCRIPTION OF PREFERRED EMBODIMENT

Figure 1:
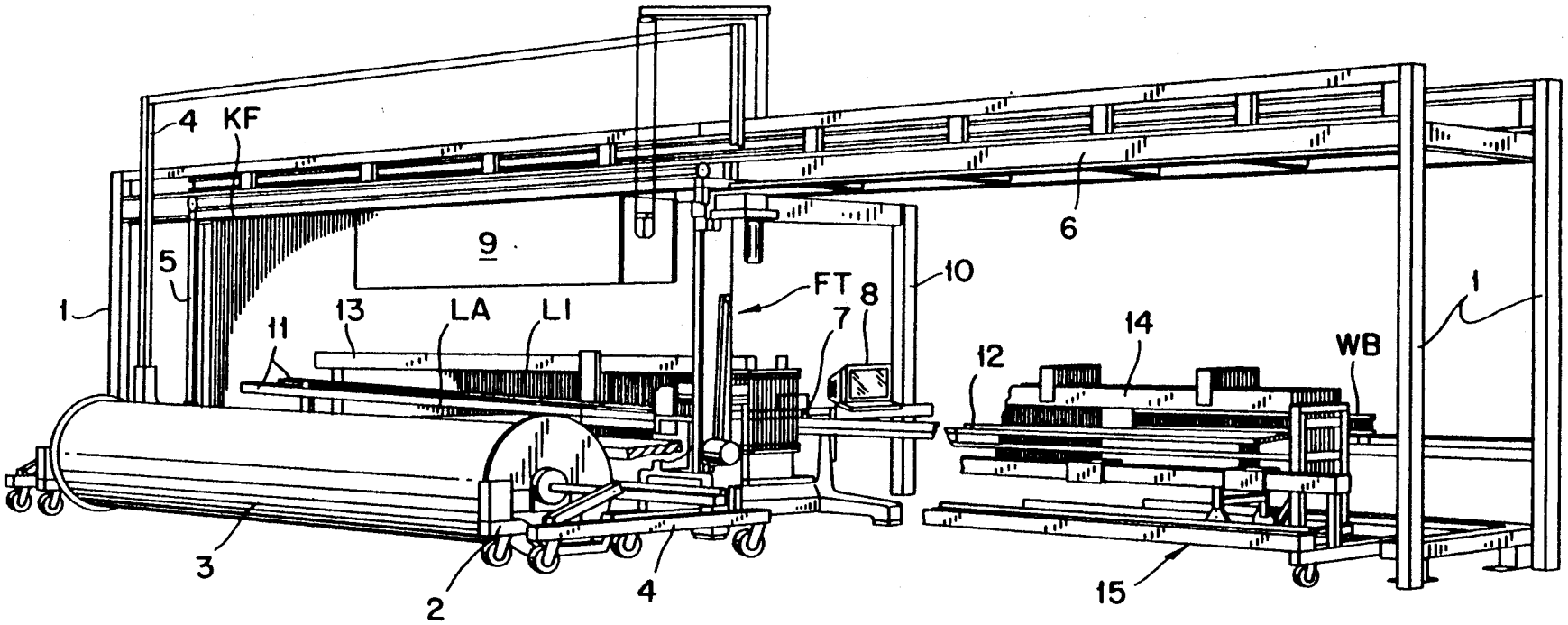
FIG. 1 is general perspective representation of the drawing-in machine.

According to FIG. 1, the drawing-in machine includes a mounting stand 1 and various subassemblies arranged in this mounting stand 1, each of which subassemblies represents a functional module. A warp beam truck 2 with a warp beam 3 arranged thereon is located in front of the mounting stand 1. The warp beam truck 2 is connected to a so-called lifting device 4 for receiving and holding a frame 5, on which the warp threads KF are clamped. This clamping is effected before the actual drawing-in and at a location separate from the drawing-in machine, the frame 5 being positioned at the bottom end of the lifting device 4 directly next to the warp beam 3. For the drawing-in, the warp-beam truck 2 (together with warp beam 3 and lifting device 4) is moved to the so-called setting-up side of the drawing-in machine and the frame 5 is lifted upwards by the lifting device 4 and hung in the mounting stand 1, where it then assumes the position shown. The frame 5 is hung in a transport apparatus (not shown) mounted on the front longitudinal girder 6 of the mounting stand 1.

During the drawing-in process, the frame 5 and the lifting device 4 together with the warp-beam truck 2 and the warp beam 3 are displaced from left to right in the longitudinal direction of the girder 6. During this displacement, the warp threads KF are directed past a thread-separating unit which has an apparatus for selecting the warp threads and for cutting off the selected warp threads KF as well as an apparatus for presenting the cut-off warp threads to a drawing-in needle 7, which forms a component of the so-called draw-in module. The selecting apparatus used in the warp tying machine USTER TOPMATIC can be used, for example, for the selection of the warp threads.

Next to the drawing-in needle 7 there is a video display unit 8, which belongs to an operating station and serves to display machine functions and malfunctions and to input data. The operating station, which forms part of a so-called programming module, also contains an input for the manual input of certain functions, such as e.g. creep motion, start/stop, repetition of operations, and the like. The drawing-in machine is controlled by a control module containing a control computer and arranged in a control box 9. Apart from the control computer, this control box contains a module computer for every so-called main module, the individual module computers being controlled and monitored by the control computer. The main modules, apart from the modules already mentioned (draw-in module, yarn module, control module and programming module), are the heald, drop-wire, and reed modules.

The thread-separating unit FT, which presents the warp threads KF to be drawn in to the drawing-in needle 7, and the path of movement of the drawing-in needle 7, which runs perpendicularly to the plane of the clamped warp threads KF, define a plane in the area of a support 10 forming part of the mounting stand which plane separates the setting-up side already mentioned from the so-called taking-down side. The warp threads and the individual elements into which the warp threads are to be drawn in are fed at the setting-up side, and the so-called harness (healds, drop wires and reed) together with the drawn-in warp threads can be removed at the taking-down side. When all warp threads KF are drawn in and the frame 5 is empty, the latter, together with the lifting device 4, the warp beam truck 2 and the warp beam 3, is located on the taking-down side and can be removed from the mounting stand.

Arranged directly behind the plane of the warp threads KF are the warp-stop-motion drop wires LA, behind the latter the healds LI and further to the rear the reed WB. The drop wires LA are stacked in hand magazines and the full hand magazines are hung in sloping feed rails 11, on which they are transported to the right towards the drawing-in needle 7 where they are separated and moved into the drawing-in position. Once drawing-in is complete, the drop wires LA pass onto drop-wire supporting rails 12 on the taking down side.

The healds LI are lined up on rails 13 and shifted on the latter to a separating unit. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12 fixed thereon, heald shafts 14 and holder for the reed, is pushed into the mounting stand 1 into the position shown and, after the drawing-in, carries the harness having the drawn-in warp threads KF. At this moment, the warp-beam truck 2 together with the warp-beam 3 is located directly in front of the harness truck 15. By means of the lifting device 4, the harness is now reloaded from the harness truck 15 into the warp-beam truck 2, which then carries the warp beam 3 and the drawn-in harness and can be moved to the relevant weaving machine or into an intermediate store.

The individual main modules of the drawing-in machine are composed of submodules which are in each case provided for certain functions. This modular construction is disclosed more fully in International Application No. PCT/CH90/00227 and U.S. application Ser. No. 07/739,475, filed Aug. 2, 1991, the disclosures of which are incorporated herein by reference.

The so-called reeding apparatus which forms the main constituent of the reed module will now be described below. The reeding apparatus serves for moving the weaving reed WB stepwise, reed gap by reed gap, past the draw-in needle 7 and for positioning it and for spreading so far apart the particular reed gap into which a yarn is to be drawn that the draw-in needle 7 can pass through. In accordance with these two functions, the reeding apparatus has transport means for the weaving reed WB and a member for opening the particular reed gap, namely a so-called reed hook.

As represented, the entire reeding device is carried by a bearer 16 which is itself screwed to a support 17 forming part of the basic stand 1. The bearer 16 is made plate-like and is oriented essentially parallel to the plane of the draw-in frame 5 (FIG. 1). At its end on the right in FIGS. 2 and 3, the bearer 16 has two stiffening ribs 18 and a closing plate 19 which projects vertically forwards and on which is mounted a stepping motor 20 schematically indicated in the Figures. The latter serves as a drive for transporting the weaving reed WB. At the end on the left in FIGS. 2 and 3, the bearer 16 has a horizontal extension 21, on which the reed opener or reed hook 22 with its drive is arranged. The position of the draw-in needle is designated by the reference symbol 23 in FIG. 3. This represents the location of the drawing-in station.

Figure 2:
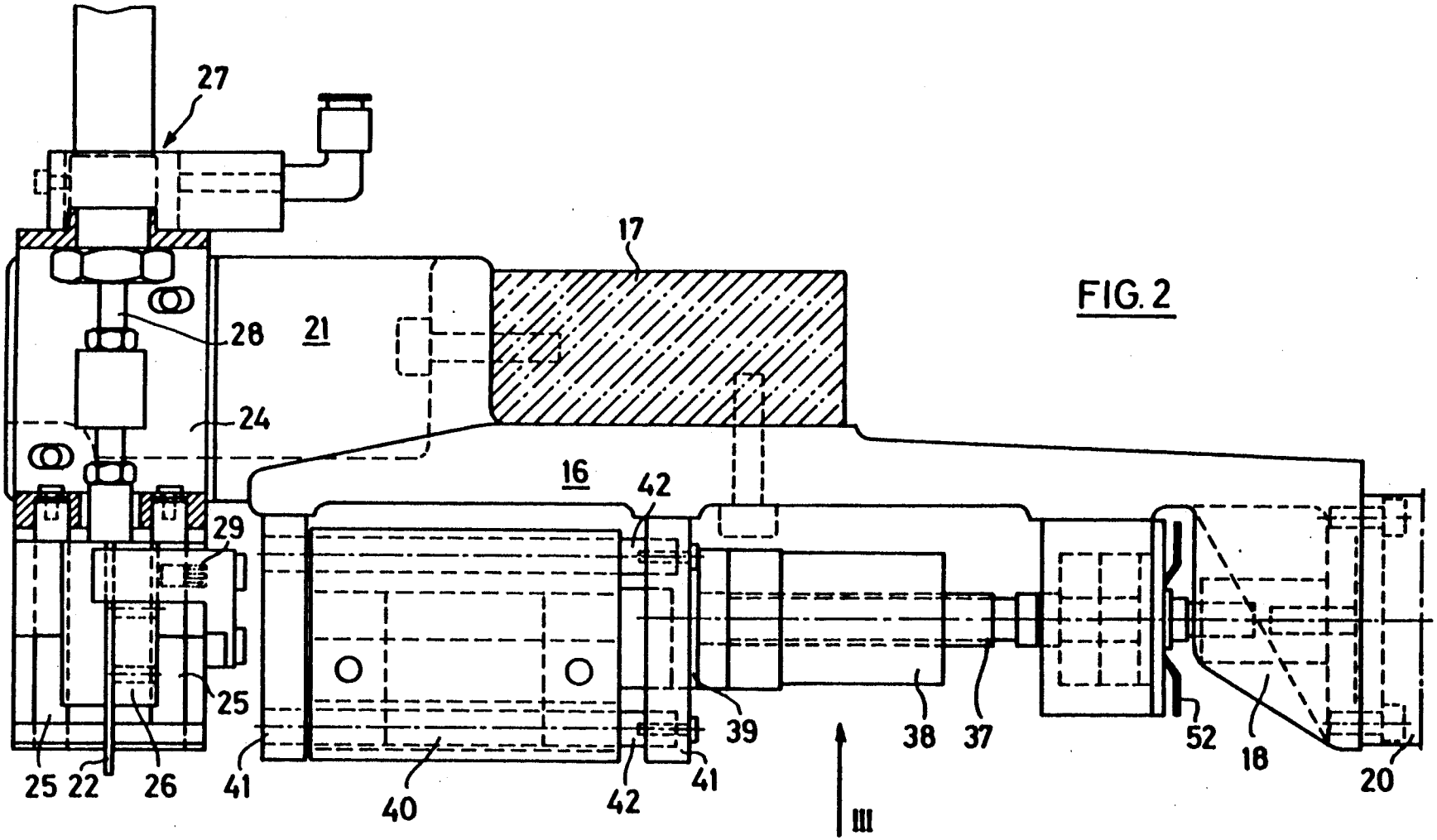
FIG. 2 is a top view of a reeding apparatus according to the invention.
Figure 4:
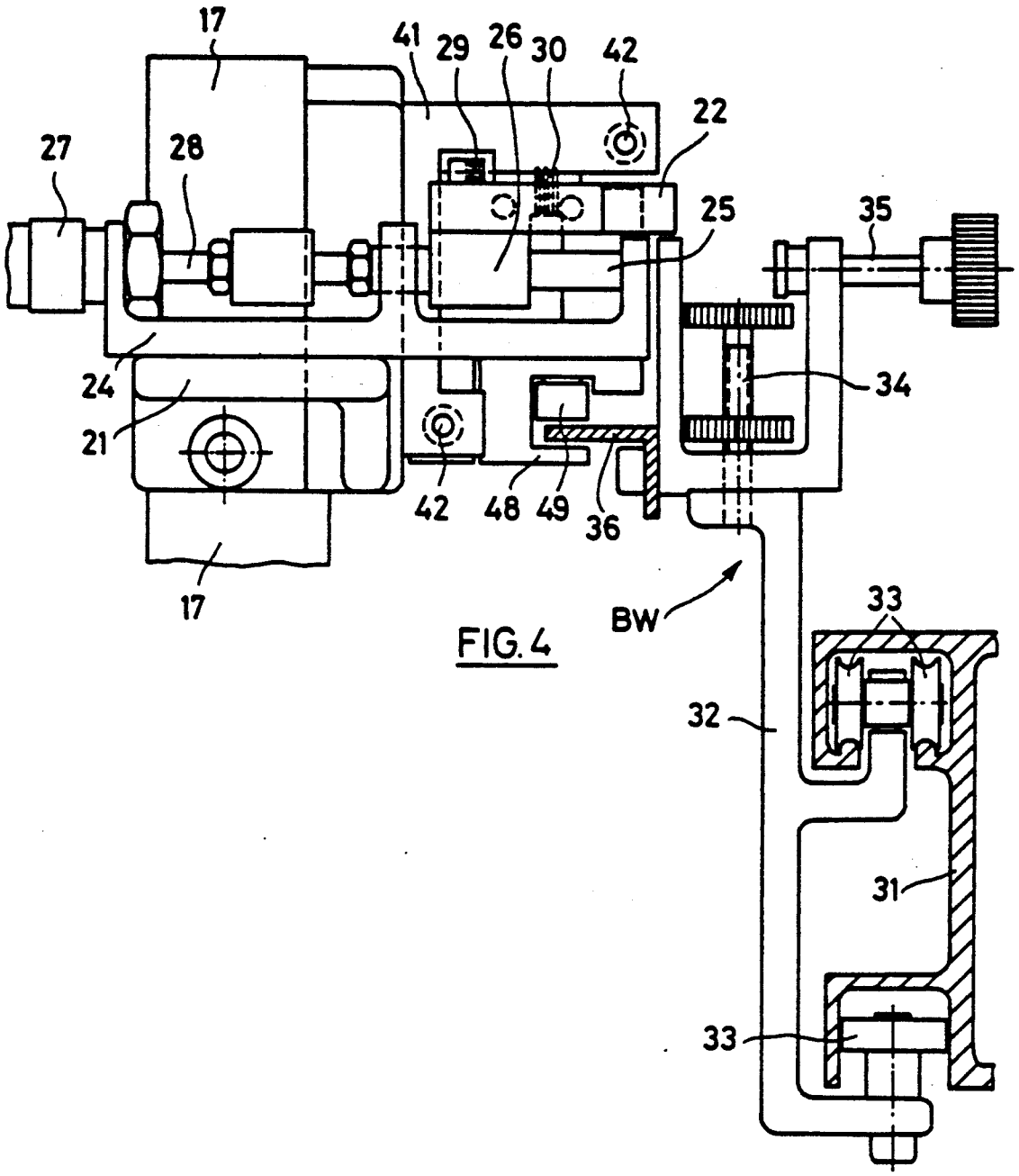
FIG. 4 is a side view in the direction of the arrow IV of FIG. 3) of the reeding apparatus as seen from the right in FIG. 1.

According to FIGS. 2 and 4, a bearer 24 with a horizontal baseplate and with a vertical front, middle and rear wall is fastened to the extension 21. Between the front and middle walls extend two guide bolts 25, on which a hook holder 26 is mounted displaceably. The latter includes a basic body and a clamping-jaw mounting carried by this and intended for the reed hook 22 which consists of a carbon-fibre-reinforced plastic, for example of PEEK (poly ether ether ketone) or LCP (liquid crystal polymer). Of course, the reed hook 22 can also consist, as heretofore, of steel; but the plastic mentioned has proved especially suitable because, with this material, both the reed teeth and, surprisingly, the hook itself experience virtually no wear and are therefore eliminated as a potential source of faults.

The hook holder 26 is connected to a piston rod 28 connected to a pneumatic drive 27 and is moved to and fro between two positions by this. In the front position shown in FIG. 2, the reed hook 22 is in engagement with the weaving reed, not shown in FIGS. 2 to 4, and thereby opens the appropriate reed gap for the passage of the draw-in needle 7 (FIG. 1) and consequently for the drawing-in of a warp yarn. In the rear position shown in FIG. 4, the weaving reed is released from the reed hook 22 and can be displaced in the direction of its length to position the next reed gap for opening by the next stroke of the reed hook. The two aforesaid positions of the hook holder 26 and therefore of the reed hook 22 are monitored by a sensor 29 for the rear position and a sensor 30 for the front position. These sensors are inductive sensors which respond to steel bodies embedded at suitable points in the hook holder 26.

The weaving reed WB is held in a reed carriage BW which is evident from FIG. 4 and which is guided displaceably in the longitudinal direction of the basic stand 1 and therefore also of the weaving reed WB. There serves as a guide a sectional rail 31 which is mounted in the basic stand 1 (FIG. 1) and in which are guided vertical reed carriers 32 arranged at a distance from one another. The reed carriers 32 consist of a lower part, to which rollers 33 running in the sectional rail 31 are fastened, and of an upper part with means 34 for height adjustment and with clamping screws 35 for fixing the weaving reed in the region of its lower collar. The individual reed carriers 32 are screwed to a sectional rail 36 which performs a double function. On the one hand, it connects the reed carriers 32 to one another and thus together with these forms the reed carriage BW. On the other hand its horizontal leg forms a kind of clampable member which can be clamped by an appropriate clamping means, so that, during the movement of this clamping means, a displacement of the reed carriage BW and therefore also of the weaving reed held therein takes place. In view of this latter function, the sectional rail 36, it is sometimes referred to hereinafter as a clamping rail.

As already mentioned, the drive of the weaving reed transport is obtained by means of the stepping motor 20 which drives a shaft 37 in oscillation. The shaft 37 is equipped with a threaded element or portion at its end further from the stepping motor 20 and in this part is surrounded by a bush 38 resembling a clasp nut, so that, as in the interaction of the leadscrew and clasp nut of a lathe, a rotational movement of the shaft 37 causes linear shifting movement of the bush 38. The bush 38 is connected to a slide 40 via a connection piece 39. This moveable slide 40 serves as a driver for the reed transport.

Figure 3:
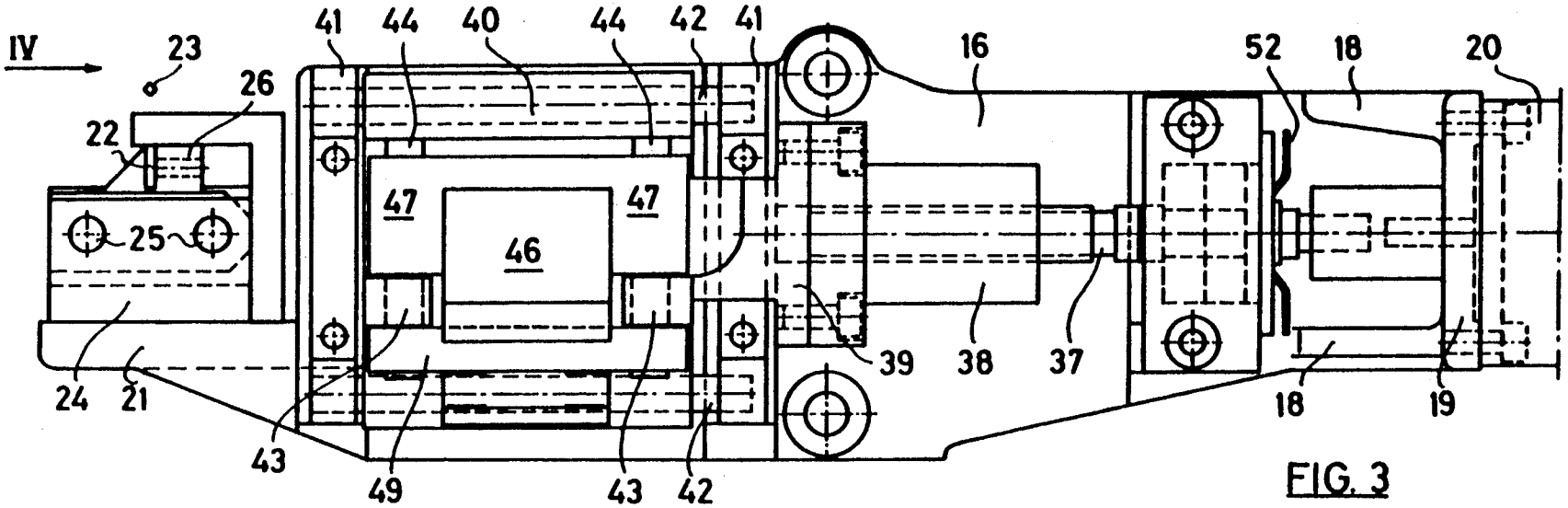
FIG. 3 is a front view (in the direction of the arrow III of FIG. 2) of the reeding apparatus as seen from the weaving reed WB.

As can be taken from FIGS. 2 to 4, fastened to the bearer 16 on each of the two sides of the slide 40 is a supporting arm 41 which has an approximately L-shaped form with the transverse leg at the top and with a short projection at the bottom. Fastened in each of these projections is a guide shaft 42 which extends between the two supporting arms 41 and which thus passes through the slide 40.

Figure 6B:
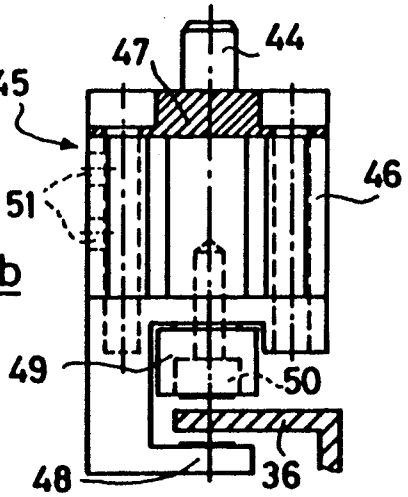
FIGS. 6*a* and 6*b* show a second detail of the reeding device in two views, specifically FIG. 6*a* being a front view and FIG. 6*b* being a view in the direction of the arrow B of FIG. 6*a*, partially in section.
Figure 6A:
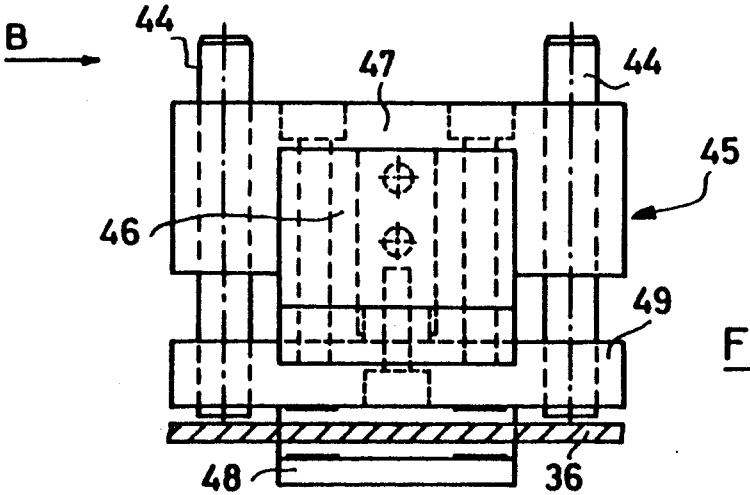
Figure 5B:
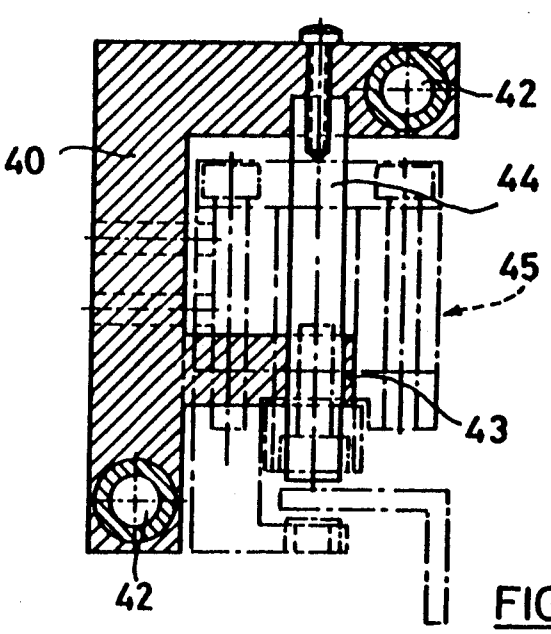
FIGS. 5*a*5*c* show first detail of the reeding device in three views, specifically FIG. 5*a* being a front view, FIG. 5*b* being a section along the line A—A of FIG. 5*a*, and FIG. 5*c* being a top view.
Figure 5A:
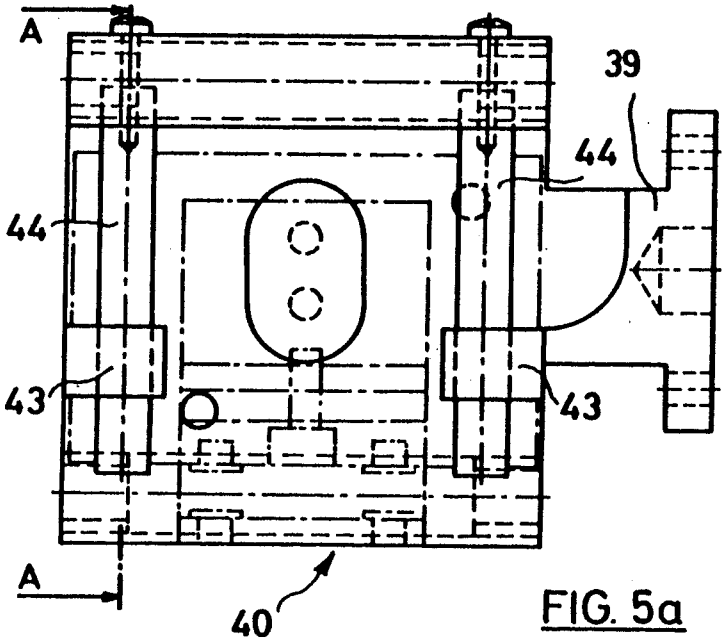
Figure 5C:
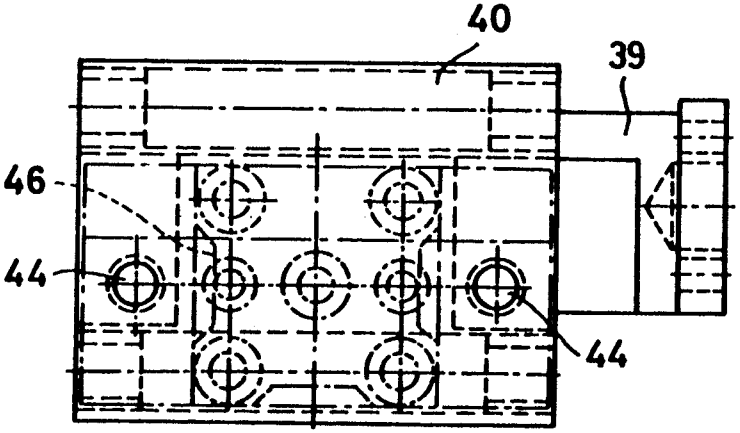

The slide 40 carries coupling means by which it may be coupled to or released from the reed carriage BW. As can be taken especially from FIGS. 5*a* to 5*c*, the slide 40 likewise has a cross-section in the form of an upturned L, and in the region of the ends of its two legs it has the guide shafts 42 passing through it and is mounted displaceably on these. In the region of its side faces adjacent to the supporting arms 41, the slide 40 has a respective crossbar 43. Arranged between the two crossbars 43 and the transverse leg of the slide 40 are two vertical guide bolts 44, on which a clamping gripper 45 is guided so as to have an adjustable stroke. This clamping gripper is illustrated in FIGS. 6*a* and 6*b*.

The principal part of the clamping gripper 45 is a pneumatic cylinder 46 which is fastened by means of four screws to a sectional part 47. This has passing through it the guide bolts 44 fastened to the slide 40. The pneumatic cylinder 46 is connected firmly to a mouthlike part which forms the first clamping jaw 48 of the clamping gripper 45. The second clamping jaw, designated by the reference symbol 49, is driven by a piston 50 of the pneumatic cylinder 46. It has the guide bolts 44 passing through it and is guided on these. As can be understood from FIGS. 5*a* and 5*b*, the crossbars 43 fashioned on the slide 40 form spacer means between the sectional part 47 and the second clamping jaw 49.

The pneumatic cylinder 46 has two air connections 51 for the supply of compressed air to close and open the clamping gripper 45. During the closing of the clamping gripper 45, the air in the pneumatic cylinder 46 pushes the piston 50 and consequently the second clamping jaw 49 downwards until the latter presses against the clamping rail 36 (FIG. 4). The entire pneumatic cylinder 46 including the first clamping jaw 48 now moves upwards relative to the second clamping jaw 49 fixed to the clamping rail 36, until the first clamping jaw 48 too presses against the clamping rail 36, with the result that the latter is fixed in the clamping gripper 45.

The reed carriage BW (FIG. 4) can now be transported one step further by the clamping gripper 45, this being obtained by means of the stepping motor 20 (FIG. 3). This is so designed that the possible division of the weaving reed (i.e., the pitch of the reed teeth or dents) is a multiple of the linear advance of the slide 40 corresponding to the step length of the stepping motor 20. Fastened on the shaft 37 driven by the stepping motor 20 is a transmitter disc 52 which has a sector-like recess with a starting edge and which is assigned an inductive sensor. This sensor controlling the transport cycle is activated by the said starting edge during the rotation of the stepping motor 20 and the transmitter disc 52, with the result that the commencement of the transport of the reed carriage BW is exactly defined and this transport is initialized. Since the transport step to be executed is of differing size, depending on the type of reed, it is set (programmed) accordingly on the stepping motor. After the angle of rotation of the transmitter disc 52 which corresponds to the predetermined transport step and which is always substantially smaller than 360°, the stepping motor 20 stops, thereby terminating the transport of the reed carriage BW. The reed hook 22 can now plunge into the appropriate leaf gap between reed dents and the stepping motor 20 and transmitter disc 52 rotate back into their initial position.

The transport of the reed carriage BW and consequently of the weaving reed takes place in the following manner. The stepping motor 20 drives via the shaft 37 and the bush 38 the slide 40 mounted horizontally displaceably on the guide shafts 42. The clamping gripper 45 is mounted vertically adjustably via the guide bolts 44 on this slide 40. The overall height of the entire clamping gripper 45 may be varied, and as a result of vertical movement of the piston 50 relative to the pneumatic cylinder 46, the two clamping jaws 48 and 49 also are adjustable to different heights. The latter means that the clamping gripper 45 can adjust automatically to different heights of the clamping rail 36.

As already described, the hook holder 26 with the reed hook 22 is driven by the pneumatic drive 27. This is completely independent of the control of the stepping motor 20 and of the drive of the pneumatic cylinder 46, so that the two functions of reed opening and reed transport are thus autonomous in mechanical terms. Their synchronization is obtained via the module computer which is contained in the control box 9 (FIG. 1) and which evaluates the signals of the sensors 29, 30 (FIGS. 2 and 4) and of the sensor assigned to the transmitter disc 52 and controls the reeding device accordingly.

The time sequence of a cycle of the individual functional steps is as follows:

1. Stand-by position of the stepping motor 20.
2. Movement of the reed hook 22 out of the weaving reed.
3. Start of the stepping motor 20 and consequently displacement of the slide 40 and transport of the reed carriage BW.
4. Stopping of the stepping motor 20 and slide 40.
5. Movement of the reed hook 22 into the weaving reed and consequently reed opening.
6. Cancellation of the clamping by the clamping gripper 45. The weaving reed is now positioned by the reed hook 22, by means of which it is also positioned to a fine setting.
7. Return of the stepping motor 20 and consequently the return transport of the slide 40 and clamping gripper 45.
8. Stand-by position of the clamping gripper 45 (stand-by time approximately 100 ms).
9. Actuation of the clamping gripper 45.
10. Cycle end.
11. Commencement of a new cycle with the movement of the reed hook 22 out of the weaving reed.

At the start of the drawing-in of a new warp, the reed carriage BW with the weaving reed is brought manually into its starting position which is marked by a stop. Since, at the start of the very first cycle, the reed hook 22 is not of course moved into the weaving reed, step no. 2 is omitted in this (first) cycle.

What is claimed is:

1. In apparatus for drawing warp yarns into a weaving reed, the combination which comprises:

a reed carriage moveable along a path extending in the lengthwise direction of a weaving reed attached thereto;

a drawing-in station located adjacent a portion of said path, said drawing-in station including a reed opener mounted for movement in a direction transverse to said lengthwise direction of a weaving reed attached to said reed carriage and means for moving said reed opener to alternately project a portion of said reed opener into a gap between adjacent dents of said reed and withdraw said portion from said reed;

a driver moveable to and fro in a direction parallel to said lengthwise direction of said weaving reed through a distance corresponding approximately to the spacing of adjacent dents of said reed; and a coupling actuatable alternately to connect said driver to said reed carriage so that said reed may be moved relative to said reed drawing-in station to position a new reed gap for reception of said reed opener and to free said reed carriage from said driver to permit movement of said driver in the opposite direction while said reed opener is positioned in a reed gap and to permit fine adjustment of the position of said reed relative to said reed opener.

2. Apparatus according to claim 1, wherein said reed carriage includes a clampable means extending along the length of a reed attached to said carriage, and wherein said coupling includes clamp means carried by said driver in position to exert a clamping action on said clampable means.

3. Apparatus according to claim 2, wherein said driver includes a slide moveable along a path parallel to said clampable means, and means for moving said driver in one direction a predetermined distance and for stopping said driver for a time and for returning said driver in the opposite direction; and said clamp means includes a pneumatic piston-cylinder unit mounted on said slide for bodily movement toward and away from said clampable means, and clamp jaws attached respectively to said piston and to said cylinder in positions on opposite sides of said clampable means so that a clamping action may be exerted on said clampable means upon activation of said piston-cylinder unit.

4. Apparatus according to claim 1, wherein said means for moving said reed opener includes first motor means, wherein second motor means in provided for said driver, and wherein said coupling includes third motor means.

5. In apparatus for sequentially opening the gaps between the teeth of a weaving reed and drawing warp yarns into such gaps, transport means for the stepwise transport of the weaving reed in its longitudinal direction with the length of the individual transport steps corresponding at least approximately to the division of the reed teeth, and a drawing-in member movable back and forth transversely to the lengthwise direction of the reed for drawing warp yarns into gaps between the teeth of the reed, said transport means comprising first transport means (BW) extending over the length of the weaving reed and coupled to such reed in the operating state, and a second transport means including a clamp gripper (45) for intermittent engagement with the first transport means.

6. Apparatus according to claim 5, wherein said first transport means is formed by a reed carriage (BW) having a clamping rail (36).

7. In apparatus for sequentially opening the gaps between the teeth of a weaving reed and drawing warp yarns into such gaps, transport means for the stepwise transport of the weaving reed in its longitudinal direction with the length of the individual transport steps corresponding at least approximately to the division of the reed teeth, and a drawing-in member movable back and forth transversely to the lengthwise direction of the reed for drawing warp yarns into gaps between the teeth of the reed, said transport means comprising first transport means extending over the length of the weaving reed and coupled to such reed in the operating state, and a second transport means for intermittent engagement with the first transport means; said first transport means being formed by a reed carriage (BW) having a clamping rail (36), and said second transport means having a clamping gripper (45) with two adjustable clamping jaws (48,49).

8. Apparatus according to claim 7, wherein a slide (40) is mounted movably in the longitudinal direction of the weaving reed and on which the clamping gripper (45) is mounted so as to be of adjustable height.

9. Apparatus according to claim 8, comprising a stepping motor (20) connected to said slide (40) by a clasp nut via a shaft (37) and a surrounding bush (38) for driving said slide.

10. Apparatus according to claim 7, wherein said clamping gripper (45) has a pneumatic cylinder (46) which is connected firmly to one clamping jaw (48).

11. Apparatus according to claim 10, including a piston (50) mounted in said pneumatic cylinder (46) and being connected to the other clamping jaw (49).

12. Apparatus according to claim 5, comprising a reed hook (22) made of plastic for opening the gaps between the teeth of the reed.

13. Apparatus according to claim 12, wherein said reed hook is made of carbon-fibre-reinforced material.

14. Apparatus according to claim 5, comprising a reed hook (22) clamped in a hook holder (26), and drive means for said hook holder which is autonomous in mechanical terms in relation to that of the second transport means (45).

15. Apparatus according to claim 14, wherein said hook holder (26) is connected via a piston rod (28) to a pneumatic drive (27) and is movable thereby to and fro between two end positions and wherein a sensor (29, 30) is provided for each of the two end positions.

16. Apparatus according to claim 15, wherein said sensors (29, 30) are formed by inductive sensors, and wherein metal parts for exciting the inductive sensors are included in the hook holder.

17. Apparatus according to claim 14, wherein said hook holder (26) with the reed hook (22) and the second transport means having a drive are arranged on a common bearer (16).

* * * * *